US008515099B2

(12) United States Patent
Staat

(10) Patent No.: US 8,515,099 B2
(45) Date of Patent: Aug. 20, 2013

(54) CAPACITOR MICROPHONE

(75) Inventor: Raimund Staat, Burgwedel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 279 days.

(21) Appl. No.: 12/985,219

(22) Filed: Jan. 5, 2011

(65) Prior Publication Data

US 2011/0176692 A1 Jul. 21, 2011

(30) Foreign Application Priority Data

Jan. 5, 2010 (DE) ..... 10 2010 000 686

(51) Int. Cl.
*H04R 3/00* (2006.01)

(52) U.S. Cl.
USPC ..... 381/111; 381/174

(58) Field of Classification Search
USPC ..... 381/91, 92, 95, 77, 67, 111, 122, 381/150, 174, 120, 113
See application file for complete search history.

(56) References Cited

U.S. PATENT DOCUMENTS

| | | | | |
|---|---|---|---|---|
| 4,541,112 | A * | 9/1985 | Kern | 381/113 |
| 6,504,937 | B1 * | 1/2003 | Papadopoulos et al. | 381/113 |
| 2004/0047477 | A1 * | 3/2004 | Bank et al. | 381/120 |
| 2005/0220314 | A1 * | 10/2005 | Lang et al. | 381/113 |
| 2005/0232442 | A1 * | 10/2005 | Seknicka | 381/92 |

* cited by examiner

*Primary Examiner* — Vivian Chin
*Assistant Examiner* — Friedrich W Fahnert
(74) *Attorney, Agent, or Firm* — Kilpatrick Townsend & Stockton LLP

(57) ABSTRACT

There is provided a capacitor microphone comprising a capacitor transducer (KW), a high frequency bridge (HFB) coupled to the capacitor transducer (KW), a high frequency coil (HFS) coupled to the high frequency bridge (HFB), an HF transformer (HFT), a synchronous demodulator (SD), a low frequency output (NFA) and a high frequency stabilizer unit (SE). The high frequency stabilizer unit (SE) is coupled between the synchronous demodulator (SD) and the low frequency output (NFA) and serves to stabilize the HF voltage.

4 Claims, 1 Drawing Sheet

CAPACITOR MICROPHONE

CROSS-REFERENCE TO RELATED APPLICATIONS

The present application claims priority to German Patent Application No. 10 2010 000 686.6, filed Jan. 5, 2010, the entire contents of which are herein incorporated by reference for all purposes.

The present invention concerns a capacitor microphone.

BACKGROUND

The sensitivity of a capacitor microphone in a high frequency circuit, referred to for brevity as an HF capacitor microphone, substantially depends on a high frequency voltage applied to a capacitor transducer of the capacitor microphone, the HF voltage in turn depending on the efficiency of the HF circuit.

If the capacitor microphone is manufactured in mass production it usually happens that there is scatter in the efficiency of the HF circuit. That can result in failure of the capacitor microphone in the circuitry and microphone test, particularly if the sensitivity differs excessively from the intended target value.

With the influence of climate on the losses in the components of the HF circuit the efficiency of the HF circuit and therewith also microphone sensitivity become climate-dependent.

It can further happen that an externally employed phantom voltage for the capacitor microphone does not afford sufficient power so that the HF voltage can drop and therewith also microphone sensitivity.

FIG. 1 shows a diagrammatic view of a capacitor microphone in accordance with the state of the art. The capacitor microphone has a symmetrical capacitor transducer KW with a diaphragm M. The capacitor microphone further has an HF bridge HFB which is formed by the capacitor transducer and the primary side of an HF coil HFS with an adjusting core. On the secondary side the HF coil HFS is coupled to an HF oscillator HFO and a synchronous demodulator SD, with two diodes D1, D2 and two capacitors and two resistors. The output of the synchronous demodulator SD is coupled to the low frequency output NFA. The capacitor microphone further has an HF transformer HFT for the HF bridge signal. In that respect the primary side of the HF transformer HFT is coupled to the primary side of the HF coil HFS and the diaphragm and the secondary side of the HF transformer HFT is coupled to the secondary side of the HF coil HFS and the low frequency output NFA. The secondary side of the HF transformer HFT is coupled to the low frequency output NFA. A capacitor C is provided at the low frequency output NFA.

SUMMARY

Thus an object of the present invention is to provide a capacitor microphone having improved stability in respect of microphone sensitivity.

Thus there is provided a capacitor microphone comprising a capacitor transducer, a high frequency bridge coupled to the capacitor transducer, a high frequency coil coupled to the high frequency bridge, an HF transformer, a synchronous demodulator, a low frequency output and a high frequency stabilizer unit. The high frequency stabilizer unit is coupled between the synchronous demodulator and the low frequency output and serves to stabilize the HF voltage.

The use of the high frequency stabilizer unit makes it possible to provide a capacitor microphone whose microphone sensitivity is substantially independent of the quality of the HF coil or the quality of the efficiency of the HF circuit.

In an aspect of the present invention the high frequency stabilizer unit has a steep current-voltage characteristic. The steep characteristic makes it possible to achieve good stabilization of the HF voltage.

In a further aspect of the present invention the stabilizer unit has at least one light emitting diode. Light emitting diodes are components which typically have a steep current-voltage characteristic and can thus be used in the stabilizer unit.

In a further aspect of the present invention the stabilizer unit has at least one green light emitting diode. Green light emitting diodes are particularly suitable as they have a particularly steep current-voltage characteristic.

The invention also concerns the use of light emitting diodes for stabilization of the HF voltage of an HF capacitor microphone.

The present invention is based on the realization that the provision of a stabilized HF voltage in an HF capacitor microphone can provide that the microphone sensitivity is independent of the quality of an HF coil or the efficiency of an HF circuit. Therefore the capacitor microphone according to the invention has an HF stabilizer unit between the synchronous demodulator SD and the LF output NFA. That stabilizer unit can optionally have a steep characteristic and can have for example two series-connected light emitting diodes LEDs, in particular green LEDs. Those light emitting diodes are particularly advantageous as they have a very steep characteristic (voltage/current) so that the HF voltage for the capacitor transducer unit remains substantially constant.

Further configurations are subject-matter of the appendant claims.

BRIEF DESCRIPTION OF THE DRAWINGS

Embodiments by way of example and advantages of the invention are described in greater detail hereinafter with reference to the drawing.

DETAILED DESCRIPTION

Figure 1:
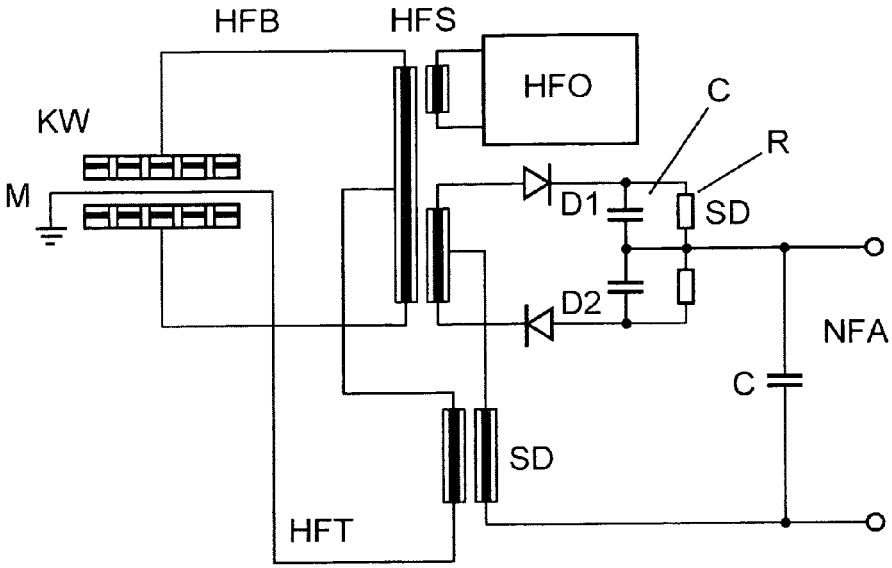
FIG. 1 shows a diagrammatic view of a capacitor microphone according to the state of the art.
Figure 2:
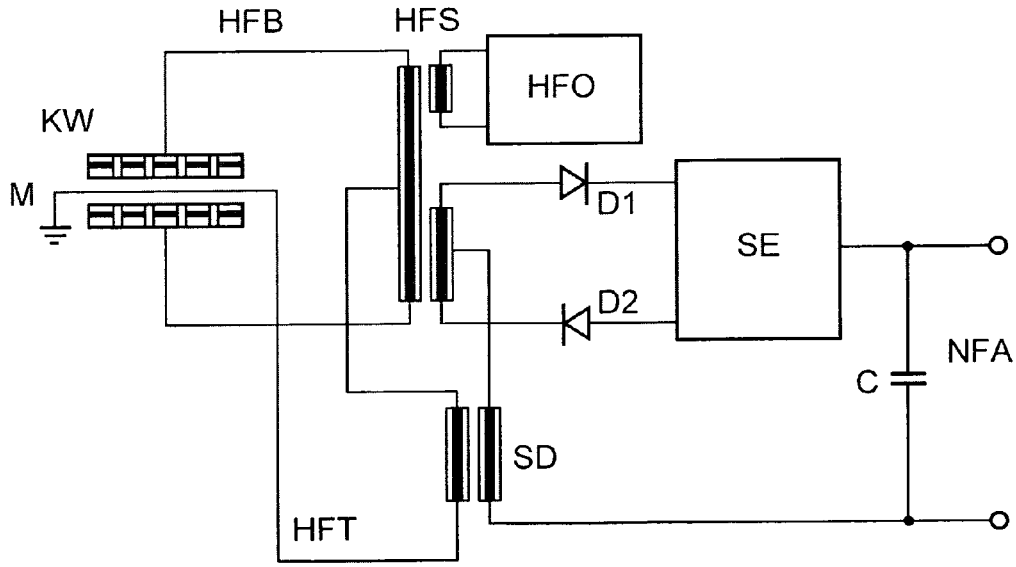
FIG. 2 shows a diagrammatic view of a capacitor microphone according to a first embodiment.

FIG. 2 shows a diagrammatic view of a capacitor microphone according to a first embodiment. The capacitor microphone has a symmetrical capacitor transducer KW with a diaphragm M. The capacitor microphone further has an HF bridge HFB coupled to the capacitor transducer and the primary side of an HF coil HFS with an adjusting core. On the secondary side of the HF coil HFS the coil is coupled to an HF oscillator HFO and a synchronous demodulator SD, with two diodes D1, D2 and two capacitors and two resistors. The capacitor microphone further has an HF transformer HFT for the HF bridge signal. In that respect the primary side of the HF transformer HFT is coupled to the primary side of the HF coil HFS and the diaphragm M and the secondary side of the HFT transformer HFT is coupled to the secondary side of the HF coil HFS and the low frequency output NFA. A capacitor C is provided at the low frequency output NFA.

According to the invention an NF stabilizer unit SE is provided between the synchronous demodulator SD with the two diodes D1, D2 and the low frequency output NFA. That stabilizer unit SE serves to keep the HF voltage constant or to stabilize the HF voltage. That can be achieved for example by the stabilizer unit SE having a very steep current-voltage characteristic.

The stabilizer unit SE can have for example one or more and in particular two light emitting diodes LED which have a steep characteristic. Those light emitting diodes can represent for example green light emitting diodes LED. The two light emitting diodes are preferably connected in series.

While in the state of the art two resistors are coupled to the first and second diodes D1, D2, in accordance with the invention two light emitting diodes LED are provided instead of the resistors. That has the advantage in particular that the HF voltage is stabilized by the very steep current-voltage characteristic of the LEDs.

Thus there is provided a capacitor microphone according to the invention which has a lesser degree of scatter in respect of microphone sensitivity, a lower level of dependency on climate and the phantom feed voltage and more stable production.

According to the invention the HF voltage is now applied to the stabilizer unit SE, in particular to two series-connected (green) light emitting diodes LED.

The invention claimed is:

1. A capacitor microphone comprising:

a capacitor transducer;

a high frequency bridge coupled to the capacitor transducer;

a high frequency coil coupled to the high frequency bridge;

an HF transformer;

a synchronous demodulator;

a low frequency output; and a high frequency stabilizer unit coupled between the synchronous demodulator and the low frequency output and serving to stabilize an HF voltage.

2. A capacitor microphone as set forth in claim 1 wherein the high frequency stabilizer unit has a steep current-voltage characteristic.

3. A capacitor microphone as set forth in claim 1 wherein the high frequency stabilizer unit has a light emitting diode or a series circuit of at least two light emitting diodes.

4. A capacitor microphone as set forth in claim 3 wherein the high frequency stabilizer unit has at least one green light emitting diode.

* * * * *